United States Patent [19]

Polsky et al.

[11] 4,062,590

[45] Dec. 13, 1977

[54] CHAIR STRUCTURE

[75] Inventors: Norman Polsky, Kansas City; Frank Burnett, Lee's Summit, both of Mo.; James L. Gerner, Shawnee Mission; Norman J. Heying, Lake Quivira, both of Kans.; Edgar M. Lieberman, Kansas City, Mo.

[73] Assignee: Fixtures Manufacturing Corporation, Kansas City, Mo.

[21] Appl. No.: 689,210

[22] Filed: May 24, 1976

[51] Int. Cl.[2] ..... A47C 7/02

[52] U.S. Cl. ..... 297/455; 297/457

[58] Field of Search ..... 297/441, 445, 457, 239; 256/47

[56] References Cited

U.S. PATENT DOCUMENTS

| | | | |
|---|---|---|---|
| 434,495 | 8/1890 | Woods | 297/457 |
| 2,260,176 | 10/1941 | Ford | 256/47 |
| 2,938,575 | 5/1960 | Molla | 297/457 X |
| 3,061,374 | 10/1962 | Grosfillex | 297/457 X |
| 3,225,431 | 12/1965 | Woodard | 297/457 |
| 3,319,999 | 5/1967 | Lieberman | 297/239 X |
| 3,767,261 | 10/1973 | Rowland | 297/445 |
| 3,774,967 | 11/1973 | Rowland | 297/445 |
| 3,844,612 | 10/1974 | Borggren | 297/441 X |

*Primary Examiner*—Roy D. Frazier
*Assistant Examiner*—Peter A. Aschenbrenner
*Attorney, Agent, or Firm*—Fishburn, Gold & Litman

[57] ABSTRACT

A chair structure comprising a one-piece, loop-shaped tubular frame having a pair of leg structures depending from and supporting the frame. A mesh body support member including a back and seat portion having a plurality of relatively closely interwoven metallic strands, with the strand ends at side and end marginal portions securely connected to the frame. The support member is formed of resiliently flexible mesh material whereby the same elastically yields to the weight of a user, such that the chair back and seat has a small curvature and an attractive appearance and yields tending to conform comfortably to the seated shape of the user.

8 Claims, 8 Drawing Figures

CHAIR STRUCTURE

This invention relates to chair structures and in particular to stacking chairs that are portable, and have comfortable seats and backs.

The principal objects of the present invention are: to provide an inexpensive chair of lightweight and sturdy construction which is completely fireproof and which is adapted to comfortably seat substantially all potential users; to provide such a chair wherein the support member is constructed of a relatively fine metallic wire mesh, for cool seating and a pleasant appearance; to provide such a chair wherein the support member is formed to the seated shape of the user for additional user comfort; to provide such a structure wherein the support member is a seat and back comprised of mesh; to provide such a chair wherein an elongated rod member positively and economically connects a support member marginal portion to the frame and serves as the support therefor; to provide such a chair wherein a plurality of spaced-apart attachment points intermittently and regularly arranged about the support member marginal portion or edge, securely attach the rod, the support member, and the frame together; to provide such a chair wherein the support marginal edge is protected to prevent fraying and exposure to sharp edges thereof; and to provide such a chair which is economical to manufacture, efficient in use, capable of long operating life and particularly well adapted for the proposed use.

Other objects and advantages of this invention will become apparent from the following description taken in connection with the accompanying drawings wherein are set forth, by way of illustration and example, certain embodiments of this invention.

The drawings constitute a part of this specification and include exemplary embodiments of the present invention and illustrate various objects and features of the apparatus.

Figure 1:
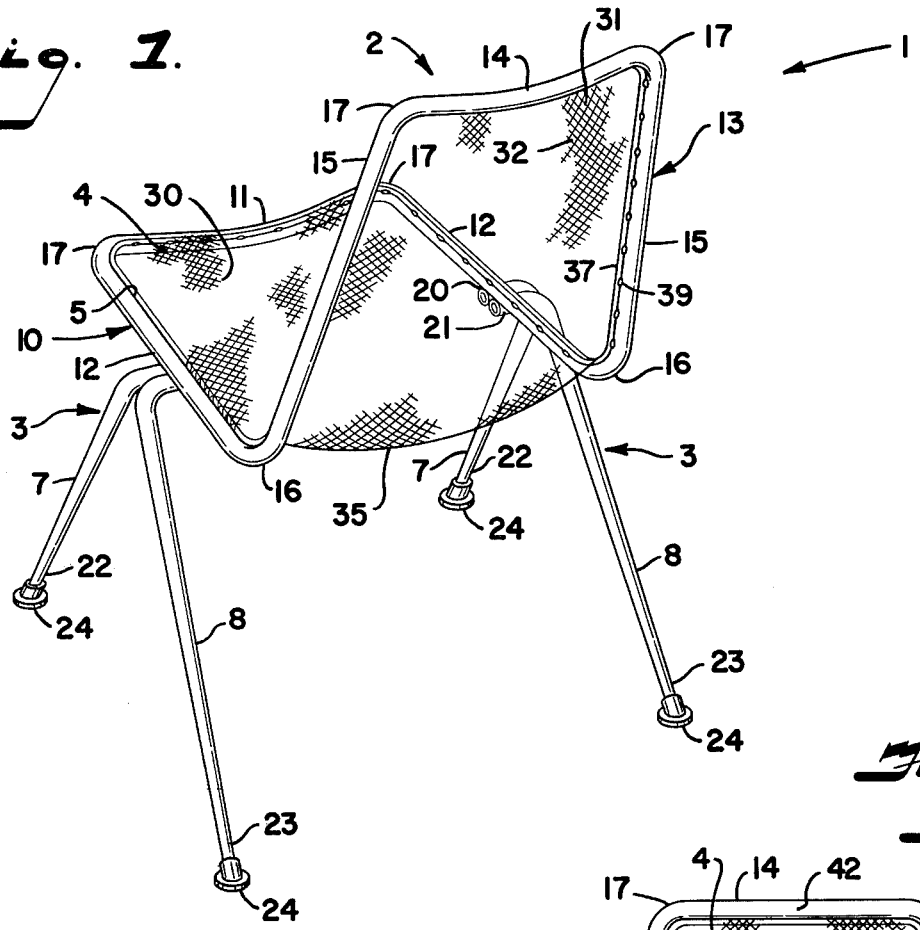
FIG. 1 is a perspective view of a chair structure embodying the present invention.
Figure 2:
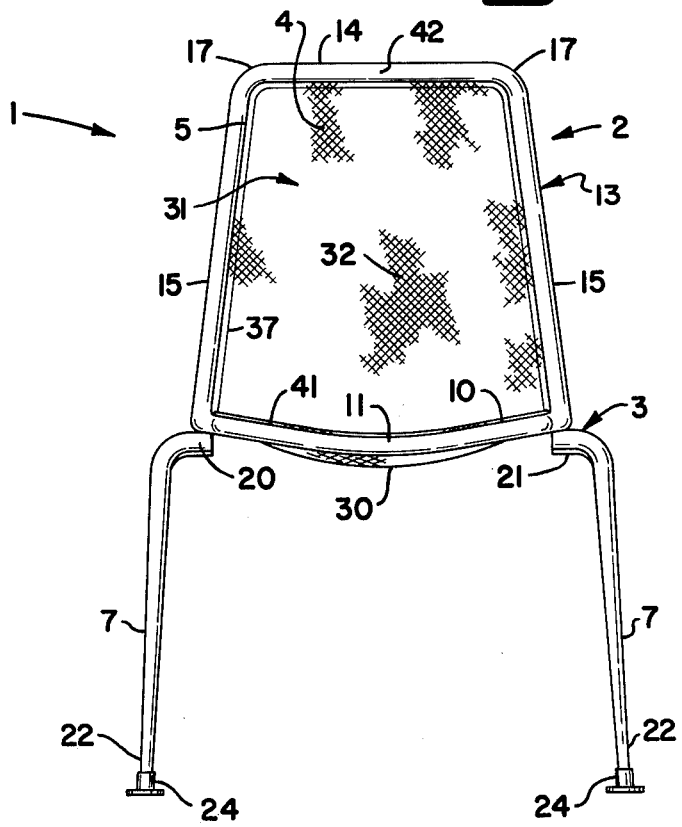
FIG. 2 is a front elevational view of the chair structure.
Figure 3:
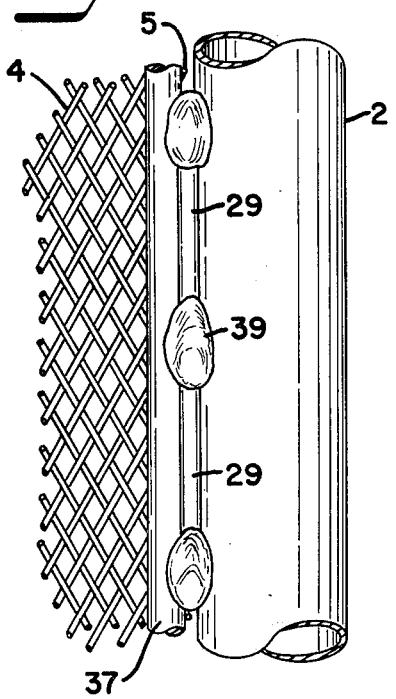
FIG. 3 is an enlarged, fragmentary, elevational view of the chair structure, particularly showing the connection of the frame, support, and fastening rod members.

Referring more in detail to the drawings:

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally designates a chair structure embodying the present invention, comprising a one-piece tubular frame 2, having a pair of leg structures 3 depending from and supporting the frame, and a mesh body support member 4 with a marginal portion or edge 5 thereof connected with the frame 2 which serves as a support therefor. The support member 4 is formed of a relatively fine, closely interwoven or knitted wire mesh member which is resiliently flexible whereby the same elastically yields to the weight of a user and conforms to the seated shape thereof.

The frame 2 includes a bottom portion 10 having a downwardly concaving, contoured front 11 and a pair of spaced sides 12 extending rearwardly and substantially perpendicularly therefrom. A rear or back portion 13 of the frame includes a rearwardly curved top 14 and a pair of spaced uprights 15 depending from the top. A pair of curved corners or portions 16 connect each side 12 with its corresponding upright 15. In the illustrated structure, the frame 2 is of a unitary or one-piece construction, is tubular with a circular cross section and preferably is formed from a suitable, rigid material and preferably of steel, aluminum, brass, or the like. Further, each frame corner 17 is arcuately rounded and sides 12 and uprights 15 respectively diverge slightly from the front 11 and top 14 to the corners 16 to provide an appropriate shape for comfortable seating.

The leg structures 3 depend from and support the frame 2 and comprise front legs 7 and rear legs 8. The leg structures 3 illustrated are arranged in pairs to present an inverted "V" with the upper ends 20 and 21 respectively of each front and rear leg member rigidly attached to opposing sides of the frame. The front and rear legs 7 and 8 respectively diverge as the lower extremeties 22 and 23 respectively thereof are approached. A foot or glide 24 is provided at each leg extremity for the non-marring engagement of the same with a floor surface. In the illustrated structure, each leg is tapered from top to foot, and the upper ends 20 and 21 are truncated to avoid interference with the seat when the user's weight is applied thereon.

The support member 4 is constructed of a wire mesh which includes a plurality of mutually interlaced, including knitted or interwoven, metallic strands 32. The wires illustrated are cylindrical, but may have any suitable cross section. The support member 4 comprises a seat portion 30 which is supported by the frame bottom 10 and a back portion 31 which bears against the frame rear 13. Further, the support member 4 is formed to partially conform to the seated shape of the user, prior to attachment to the frame, and is resiliently flexible. The support member 4 elastically yields to the weight of a user resting thereon, such that the chair back 31 and seat 30 tend to comfortably conform to the seated shape of any user. In the illustrated chair, the wire mesh is cut and shaped along the bias, and attached to the frame 2 such that the interlacing strands 33 and 34 are oriented diagonally between the side, front and top members of the frame. By attaching the illustrated support member 4 to the frame 2 along the bias in this manner, which is illustrated as being in the nature of 45 degrees, the chair is provided with additional flexibility and sitting comfort. Also, the strands are preferably constructed of a suitable metal wire such as steel, brass, aluminum or the like, having a diameter in the range of 0.015 to 0.040 inch to prevent the support member from inelastically stretching. The wire mesh acts like a spring when the load placed thereon is removed, by relaxing to its originally unstressed position to provide an appealing appearance. The mesh of the illustrated support member 4 which is commercially understood and defined as the number of apertures or openings between each strand per lineal inch, is preferably in the range of 3 × 3 to 18 × 18 and may be any rectangular combination thereof, such as 3 × 8, 12 × 8, 18 × 14, and the like. The support member may comprise separate seat and back portions, and is illustrated as being of a one-piece construction including an intermediary portion 35 between and integral with the seat 30 and the back 31. The intermediary portion 35 as well as seat 30 and back 31 are slightly concave to readily conform to the user's seated shape. Seat 30 and back 31 curvingly mate with frame front 11 and top 14.

The mesh is connected with the frame 2 so as to suspend said support member seat and back totally within the frame. To improve the chair's comfort and appearance, body support member 4 preferably has connection inside the frame 2 in a mutually non-convoluted fashion whereby the support does not wrap or wind about any portion of the frame. The structure illustrated in FIG. 4 includes a cylindrical rod member 37 having a shape substantially similar to that of the frame and being peripherally slightly smaller than the inside dimension of the frame, and is adapted to fit within the frame. The rod member 37 which may be segmented to facilitate manufacture, is preferably constructed from metal such as steel, aluminum, brass or the like, that is compatible with the frame and mesh for suitable securing of same together. The support member's marginal edge 5 is formed abuttingly around the rod member 37 along its entire perimeter, and is foldingly doubled back upon itself along an edge portion 29. The support member's outermost end edge 36 is positioned between the frame 2 and the rod 37 to prevent the mesh from fraying and to protect the user from exposure to the sharp edges thereof. Means are provided for clamping the rod 37 and the frame 2 together thereby retaining the marginal edge 5 therebetween. In the illustrated structure, a plurality of spaced-apart weld spots 39 are intermittently and regularly arranged about the support member marginal edge in the order of two inches apart. Each weld spot 39 fuses the rod 37, the support member 4, and the frame 2 integrally and securely together. For improved sitting comfort, the body supporting surface 40 of support member 4 is substantially coplanar with and preferably slightly below the frame front uppermost surface 41 along the mutually connected edges thereof. Similarly, the frame top forwardmost surface 42 is substantially coplanar and preferably slightly forward of the body supporting surface 40 along their mutually connected edges.

The chair structures 1 are adapted for vertical, nested stacking. In this example, the leg structures 3 of each chair is formed in a manner which permits the lower surface of the leg ends 20 and 21 to abuttingly rest upon the sides 12 of a lower stacked chair of similar shape, thereby maintaining the stacked chairs' spaced relation.

Figure 5:
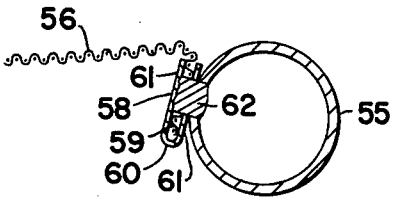
FIG. 5 is a fragmentary, cross-sectional view of another embodiment of the present invention particularly showing a channel member for connecting the various chair members.

Another embodiment of the present invention is illustrated in FIG. 5 and includes a frame 55, a wire mesh body support member 56, and an elongated channel strip 58 disposed about the end or marginal edge 59 of the support member. The strip 58 includes a base 60 with upstanding side walls 61 attached thereto. The marginal edge 59 of the support member is attached between the strip side walls 61 by means such as soldering, crimping or the like to prevent fraying and exposed sharp edges thereof. The channel strip 58 is positioned along an inside surface of the frame 55 and is connected therewith by suitable means such as plug welds 62.

Figure 6:
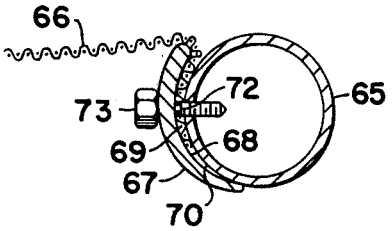
FIG. 6 is a fragmentary, cross-sectional view of another embodiment of the present invention particularly showing clamping strips for connecting the mesh and frame members.
Figure 7:
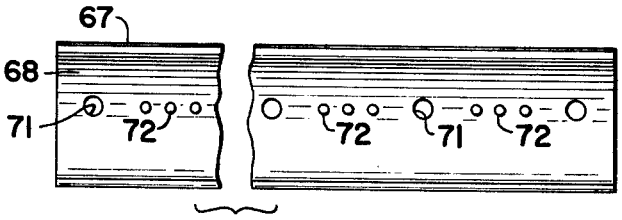
FIG. 7 is an elevational view of one of said strips showing an interior surface thereof.

Another embodiment of the present invention is illustrated in FIGS. 6 and 7 and includes a frame 65, a wire mesh body support member 66 and a plurality of clamping strips 67. Each of the clamping strips 67 includes an inner face 68 thereof clampingly engaging a marginal edge portion 69 of the support member 66 between the face and a cooperating portion 70 of the frame 65. In this example, the frame has a circular cross section, and the clamping strips 67 are crescent shaped with the inner face 68 and the cooperating portion 70 being arcuate. Means are provided for urging each of the clamping strips 67 toward its cooperating portion of the frame 65. In the illustrated structure, apertures 71 are provided through each of the clamping strips to facilitate attaching the same to the frame by means such as rivets, bolts, plug welding or metal screws 73. Further, a plurality of protuberances 72 are disposed on the inner face 68, extend outwardly toward the frame 65 therefrom, and engage the wire mesh body support member 66 between the apertures thereof to provide additional retaining grip.

Figure 8:
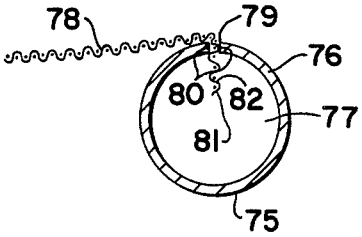
FIG. 8 is a fragmentary, cross-sectional view of another embodiment of the present invention particularly showing a crimped split frame engaging the chair mesh.

Another embodiment of the present invention is illustrated in FIG. 8 and includes a tubular frame 75 having a side wall 76, a central aperture 77, and a wire mesh body support member 78 disposed within a slot 79 through the side wall. The slot 79 extends marginally about the entire frame and includes a pair of opposing edges 80. The end 81 of each strand is disposed within the central aperture 77 of the frame 75 and is attached thereto by means such as welding, brazing, crimping, or the like. The strand ends 81 may be turned upwardly to form a U-shaped marginal edge portion (not shown) of the support member. The frame side wall 76 is crimped about the wire mesh body support member 78. The opposing slot edges 80 being thereby converged, engage the marginal edge 82 and retain the same therein.

Figure 4:
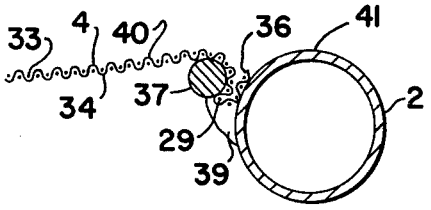
FIG. 4 is a fragmentary, cross-sectional view of the chair structure taken through the frame, support, and fastening rod members at a point of mutual attachment.

In the manufacture of the chair structure illustrated in FIG. 4, a support member blank having a marginal dimension slightly larger than that of the body supporting surface 40 is cut from a sheet of suitable wire mesh material. The doubled back marginal edge 5 is then formed while the remainder of the blank is held in a substantially flat condition. The frame 2 and formed blank are then positioned in a fixture which retains said members in an aligned position for assembly and attachment. The mesh, frame, and rod members are then assembled and attached securely together. Preferably, the support member blank is cut and folded in a manner whereby before assembly, the marginal dimension of the same is slightly larger than that of the cooperating portion of the frame, thereby producing the concave portions of the body supporting surface 40.

It is to be understood that while we have illustrated and described certain forms of our invention, it is not to be limited to the specific forms or arrangement of parts herein described and shown.

What we claim and desire to secure by Letters Patent is:

1. A chair structure comprising:

a. a seat and back frame of closed configuration having connected seat and back side members at each side with a front member connecting the seat side members and extending across and forming the front of a seat portion of the frame and with a top member connecting the back side members and extending across and forming the top of a back portion of the frame;

b. means attached to said frame for supporting said frame above a surface;

c. a body support member extending between said side, front and top members of said seat and back frame and having side and end marginal portions secured thereto, said body support member being a plurality of closely spaced interlaced metallic strands and comprising a mesh body, said mesh body being formed into a body supporting surface with the strands oriented diagonally between the side, front and top members of said seat and back frame;

d. means for fastening said body support member along the length of the marginal edge portion thereof to respective side, front and top members of said frame;

e. said fastening means comprising a rod member of closed configuration similar to that of said frame and being marginally smaller than an inside marginal dimension of said frame;

f. said body support member marginal edge portion being partially wrapped in one direction about said rod member and doubled back in the opposite direction forming a mesh sandwich attachment portion disposed between said rod member and said frame; and g. means securing said rod member to the inner marginal dimension of said frame with said mesh sandwich portion therebetween.

2. A chair structure as set forth in claim 1 wherein:

a. said securing means are spaced spot welds extending between said rod member and the inner marginal dimension of said frame.

3. A chair structure as set forth in claim 1 wherein:

a. said strands are each single metallic wires.

4. A chair structure as set forth in claim 1 wherein:

a. said support member has a mesh in the nature of 12 × 12.

5. A chair structure as set forth in claim 1 wherein:

a. said strands are each single metallic wire each having a diameter in the nature of 0.025 inch.

6. A chair structure as set forth in claim 1 wherein:

a. said frame and said body support are mutually non-convoluted whereby said body support member does not extend over any member of said frame.

7. A chair structure as set forth in claim 1 wherein:

a. said frame has a circular transverse cross section.

8. A chair structure as set forth in claim 1 wherein:

a. said rod member is a cylindrical rod member.

* * * * *